US007242372B2

(12) United States Patent
Onozawa et al.

(10) Patent No.: US 7,242,372 B2
(45) Date of Patent: Jul. 10, 2007

(54) PLASMA DISPLAY APPARATUS

(75) Inventors: Makoto Onozawa, Kawasaki (JP); Michitaka Ohsawa, Kawasaki (JP); Tomokatsu Kishi, Kawasaki (JP); Yoshikazu Kanazawa, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 434 days.

(21) Appl. No.: 10/109,649

(22) Filed: Apr. 1, 2002

(65) Prior Publication Data

US 2002/0175883 A1 Nov. 28, 2002

(30) Foreign Application Priority Data

May 22, 2001 (JP) ..... 2001-152744

(51) Int. Cl.
*G09G 3/10* (2006.01)
*G09G 3/28* (2006.01)

(52) U.S. Cl. ..... 345/42; 345/37; 345/41; 345/60

(58) Field of Classification Search ..... 345/55, 345/60, 76, 37, 41, 42; 315/205
See application file for complete search history.

(56) References Cited

U.S. PATENT DOCUMENTS 4,849,683 A * 7/1989 Flolid ..... 323/284
5,293,077 A * 3/1994 Seki et al. ..... 307/10.8
5,828,353 A * 10/1998 Kishi et al. ..... 345/55
5,844,373 A * 12/1998 Yao et al. ..... 315/205
5,943,030 A * 8/1999 Minamibayashi ..... 345/60
6,741,238 B2 * 5/2004 Choi ..... 345/211

FOREIGN PATENT DOCUMENTS

| | | |
|---|---|---|
| EP | 1 030 286 | 8/2000 |
| JP | 6-332401 | 12/1994 |
| JP | 9-68946 | 3/1997 |
| JP | 2000-194316 | 7/2000 |

* cited by examiner

*Primary Examiner*—Sumati Lefkowitz
*Assistant Examiner*—Srilakshmi K Kumar
(74) *Attorney, Agent, or Firm*—Staas & Halsey LLP

(57) ABSTRACT

A plasma display apparatus, in which a sustain output device (transistor) with a voltage rating in accordance with the sustain voltage can be used even when a voltage greater than the sustain voltage is applied to a sustain electrode in the reset period and the address period, has been disclosed, wherein, an X or a Y drive circuit, to which a voltage greater than the sustain voltage is applied, comprises a first switch provided between a second sustain drive transistor and the supply source of a second voltage, and the voltage is supplied to the sustain drive transistor in the state in which the first switch is open.

6 Claims, 14 Drawing Sheets

PLASMA DISPLAY APPARATUS

BACKGROUND OF THE INVENTION

The present invention relates to a plasma display apparatus. More particularly, the present invention relates to an improvement of a drive circuit that applies a voltage pulse to an electrode at which a sustain discharge is caused to occur.

The plasma display apparatus has been put to practical use as a flat display and is a thin display apparatus of a high intensity. FIG. 1 is a diagram that shows the general structure of a conventional three-electrode AC-driven plasma display apparatus. As shown schematically, the plasma display apparatus comprises a plasma display panel (PDP) 1 composed of two substrates, between which a discharge gas is sealed, each substrate having plural X electrodes (X1, X2, X3, . . . , Xn) and Y electrodes (Y1, Y2, Y3, . . . , Yn) arranged adjacently, plural address electrodes (A1, A2, A3, . . . , Am) arranged in the intersecting direction thereto, and fluorescent materials arranged at intersecting parts, an address driver 2 that applies pulses such as an address pulse to the address electrode, an X common driver 3 that applies pulses such as a sustain discharge pulse to the X electrode, a scan driver 4 that applies pulses such as a scan pulse sequentially to the Y electrode, a Y common driver 5 that applies pulses such as a sustain discharge pulse to be applied to the Y electrode to the scan driver 4, and a control circuit 6 that controls each section, and the control circuit 6 further comprises a display data control section 7 that includes a frame memory and a drive control circuit 8 composed of a scan driver control section 9 and a common driver control section 10. As the plasma display apparatus is widely known, a more detailed description of the entire apparatus is omitted here and only the X common driver 3 and the Y common driver 5 that relate to the present invention are further described. The X common driver, the scan driver, and the Y common driver of the plasma display apparatus have been disclosed, for example, in Japanese Unexamined Patent Publication (Kokai) No. 9-68946 and Japanese Unexamined Patent Publication (Kokai) No. 2000-194316.

FIG. 2 is a diagram that shows an example of the structure of the X common driver, the scan driver, and the Y common driver, which have been disclosed as described above. Plural X electrodes are connected commonly and driven by the X common driver 3. The X common driver 3 comprises output devices (transistors) Q8, Q9, Q10, and Q11, which are provided between the common X electrode terminal and a voltage source +Vs1, between that and −Vs2, between that and +Vx, and between that and −Vwx, respectively. By turning on any one of the transistors, the corresponding voltage is supplied to the common X electrode terminal. The scan driver 4 is composed of individual driver provided for each Y electrode and each individual driver comprises transistors Q1 and Q2, and diodes D1 and D2 provided in parallel thereto. Each of one end of transistors Q1 and Q2, and diodes D1 and D2 of each individual driver is connected to each Y electrode and each of the other end is connected commonly to the Y common driver 5. The Y common driver 5 comprises transistors Q3, Q4, Q5, Q6, and Q7, which are provided between the line from the scan driver 4 and the voltage source +Vs1, between that and −Vs2, between that and +Vwy, between that and +Vy, and between that and a ground (GND), respectively, and the transistors Q3, Q5, and Q7 are connected to the transistor Q1 and the diode D1, and the transistors Q4 35 and Q6, to the transistor Q2 and the diode D2.

In the reset period, Q5 and Q11 are turned on while the other transistors are turned off, and +Vwy is applied to the Y electrode and −Vwx is applied to the X electrode to generate an entire write and erase pulse that puts the display cells on the panel 1 into a uniform state. At this time, the voltage +Vwy is applied to the Y electrode via Q5 and D1. In the address period, Q6, Q7, and Q10 are turned on while the other transistors are turned off, and +Vx is applied to the X electrode, the voltage +Vy, to the terminal of Q2, and GND is applied to the terminal of Q1. With this state, an scan pulse that turns Q1 on and Q2 off is applied sequentially to individual drivers. At this time, in individual drives to which a scan pulse is not applied, Q1 is turned off and Q2 is turned on, therefore, GND is applied to the Y electrode, to which the scan pulse has been applied, via Q1, +Vy is applied to the other Y electrodes via Q2, and an address discharge is caused to occur between the address electrode to which a positive data voltage is applied and the Y electrode to which the scan pulse has been applied. In this way, each cell in the panel is put into a state according to the display data.

In the sustain discharge period, while Q1, Q2, Q5–Q7, Q10, and Q11 are being kept off, Q3 and Q9, and Q4 and Q8 are alternately turned on. These transistors are called the sustain transistors here. In this way, +Vs1 and −Vs2 are alternately applied to the Y electrode and the X electrode and a sustain discharge is caused to occur for display in the cell in which an address discharge has been caused to occur in the address period. At this time, if Q3 is turned on, +Vs1 is applied to the Y electrode via D1, and if Q4 is turned on, −Vs2 is applied to the Y electrode via D2. In other words, the voltage Vs1+Vs2 is alternately applied to the X electrode and the Y electrode with a reversed polarity in the sustain discharge period. This voltage is called the sustain voltage here.

The example described above is only one of various examples, and there are various modifications as to which kind of voltage is applied in the reset period, the address period, and the sustain discharge period, and there are also various modifications of the scan driver 4, the Y common driver 5, and the X common driver 6.

The scan pulse needs to be applied sequentially to each Y electrode, therefore, Q1 and Q2 that relate to the application of the scan pulse are required to be capable of high-speed operations. Moreover, since the number of times a sustain discharge is caused to occur affects the display intensity and as many sustain discharges as possible need to be caused to occur in a fixed period, the sustain transistors Q3, Q4, Q8, and Q9, which relate to the application of the sustain discharge pulse, are also required to be capable of high-speed operations. On the other hand, in the plasma display apparatus, it is necessary to apply a high voltage to each electrode in order to cause a discharge to occur, therefore, the transistors are required to have a high withstand voltage to resist a great voltage. A transistor, which has a high withstand voltage but has a relatively low operating speed, or a transistor, which has a high operating speed but has a relatively low withstand voltage, can be manufactured at a low cost, but that which has not only a high withstand voltage but also a high operating speed is costly.

Among the transistors in FIG. 2, the operating speed of Q6, Q7, Q10, and Q11 can be relatively low because they do not directly relate to the application of the scan pulse and the sustain discharge pulse, which requires a high-speed operation. Although a high-speed operation is required for Q1 and Q2, the withstand voltage thereof can be relatively small, because D1 and D2 are provided in parallel thereto, the voltages to be applied are +Vy and GND, and the difference in voltage therebetween is relatively small.

Contrary to this, the sustain transistors Q3, Q4, Q8, and Q9 need to be capable of high-speed operations and a high voltage is applied thereto as well. As shown in FIG. 2, in the X common driver 3, the X electrode connected commonly is connected to +Vs1, −Vs2, +Vx, and −Vwx via Q8, Q9, Q10, and Q11, respectively, and when Q8 is on, +Vs1 is applied to the common X electrode therefore the voltage Vs1+Vs2 (sustain voltage) is applied across Q9, and when Q10 is on, +Vx is applied to the common X electrode therefore the voltage Vx+Vs2 is applied across Q9. Similarly, Vs1+Vs2 or Vs1+Vwx is applied across Q8. Therefore, if Vs1>Vx and Vs2>Vwx, the transistors Q8 and Q9 are required only to have a withstand voltage of Vs1+Vs2 or greater, that is, the sustain voltage. If Vx>Vs1, Q9 needs to have a withstand voltage of Vx+Vs2 or greater, and if Vwx>Vs2, Q8 needs to have a withstand voltage of Vs1+Vwx or greater. As described above, the transistors Q8 and Q9 need to have a withstand voltage of the sustain voltage or greater because a sustain discharge is applied thereto, and if Vx>Vs1 or Vwx>Vs2, a greater withstand voltage is required.

In the Y common driver 5, the anode of the diode D1 is connected to +Vs1, +vwy, and GND via Q3, Q5, and Q7, respectively, and the cathode of the diode D2 is connected to −Vs2 and +Vy via Q4 and Q6, respectively. When Q3 is on, +Vs1 is applied to each Y electrode, and the voltage is further applied to the terminal of Q4 via D2, therefore, the voltage Vs1+Vs2 (sustain voltage) is applied across Q4 as a result. Similarly, when Q5 is on, the voltage Vwy+Vs2 is applied across Q4, and when Q4 is on, Vs1+Vs2 is applied across Q3. When Q6 is on, the voltage Vy+Vs2 is applied across Q4. Therefore, the transistors Q3 and Q4 are required to have a withstand voltage equal to or greater than the sustain voltage because the sustain discharge pulse is applied thereto, and Q3 is required to have a greater withstand voltage if Vwy>Vs1 or Vy>Vs1.

Generally, when the voltage rating of the sustain output device (transistor) is high, the saturation voltage of the device is also high and, in order to lower the saturation voltage, measures such as to drive plural devices in parallel and to use a device the chip size and the size of which are large will be required, resulting in a problem that the cost is raised accordingly.

SUMMARY OF INVENTION

The present invention will solve these problems and the object is to realize a circuit that can use a sustain output device (transistor) of the voltage rating in accordance with the sustain voltage, even when a voltage greater than the sustain voltage is applied to the sustain electrode (X electrode and Y electrode) in the reset period and the address period in the plasma display apparatus.

FIG. 3A through FIG. 3C are diagrams that show the fundamental structure of the sustain electrode drive circuit of the present invention. The diagrams are generalized. As for the X electrode, it corresponds directly to the sustain electrode. As for the Y electrode, a scan driver is interposed and the diagrams correspond to a case in which a live scan driver is omitted.

FIG. 3A shows the structure in which the voltage Vw greater than +Vs1 is applied in the reset period and the address period, when the greater sustain voltage is assumed to be +Vs1 and the lesser sustain voltage is assumed to be −Vs2. As shown schematically, sustain output devices (transistors) Q21 and Q22 are connected to each other and the connection node is connected to the sustain electrode (X electrode, Y electrode). The other terminal of Q21 is connected to the voltage source +Vs1 and the other terminal of Q22 is connected to the voltage source −Vs2 via a switch SW1 and connected to the voltage source +Vw via a switch SW2. In this structure, the switch SW1 is turned on (connected state) and the switch SW2 is turned off (cut-off state) to apply +Vs1 and −Vs2 to the terminals of Q21 and Q22, respectively, and the sustain voltages (+Vs1, −Vs2) to the sustain electrode in the sustain discharge period. Therefore, the voltage rating of Q1 and Q2 only needs only to be Vs1+Vs2 or greater. When +Vw is applied, the switch SW1 is turned off and the switch SW2 is turned on to apply +Vs1 and +Vw to the terminals of Q21 and Q22, respectively, and Q22 is turned on. At this time, Vw−Vs1 is applied to Q21, but this is less than Vw−Vs2, and actually less than Vs1+Vs2.

Although the greater voltage Vw−Vs2 is applied to the switches SW1 and SW2, these are not required to be capable of high-speed operations and can be manufactured to be compact and low cost. Although it is assumed here in the description that the polarity of −Vs2 is opposite to those of +Vs1 and +Vw, it can be ground or the same polarity, and the same effects can be attained.

FIG. 3B is a diagram that shows the structure in which the voltage −Vw less than −Vs2 is applied in the reset period and the address period. As shown schematically, the sustain output devices (transistors) Q21 and Q22 are connected to each other and the connection node is connected to the sustain electrode (X electrode, Y electrode). The other terminal of Q22 is connected to the voltage source −Vs2 and the other terminal of Q21 is connected to the voltage source +Vs1 via the switch SW1, and is connected to the voltage source −Vw via the switch SW2. The other parts are identical with those in FIG. 3A and a description is omitted.

FIG. 3C is a diagram that shows the structure in which a capacitor C is provided in parallel to the sustain transistors Q21 and Q22 connected in series, and is separated from the sustain voltage source in the state in which the sustain voltage Vs1+Vs2 is maintained across the capacitor C, and the voltage +Vw is applied to one terminal of the capacitor C to raise the voltage of the other terminal thereof to the high voltage Vs1+Vs2+Vw, which is then applied to the sustain transistor Q21. As shown schematically, the sustain output devices (transistors) Q21 and Q22 are connected to each other and the connection node is connected to the sustain electrode. The other terminal of Q21 is connected to the voltage source +Vs1 via a diode D3 that functions as a switch SW3, and the other terminal of Q22 is connected to the voltage source −Vs2 via the switch SW1, and simultaneously is connected to the voltage source +Vw via the switch SW2. The capacitor C is connected between the other terminals of Q21 and Q22.

In this structure, the switch SW1 is turned on (connected state), the switch SW2 is turned off (cut-off state), +Vs1 and −Vs2 are applied to the terminals of Q21 and Q22, respectively, and the sustain voltages (+Vs1, −Vs2) are applied to the sustain electrode in the sustain period. When a high voltage is applied, the switch SW1 turned on and with the state in which Vs1+Vs2 is maintained across the capacitor C, the switch SW1 is turned off and the switch SW2 is turned on. In this way, the voltage of the other terminal of the capacitor C, that is the other terminal of Q21, becomes Vs1+Vs2+Vw and is applied to the sustain electrode. At this time, the diode 3 enters the off state and SW3 enters the cut-off state. In this structure, the voltage applied to the terminals of Q21 and Q22 is Vs1+Vs2 in both the cases where the sustain voltage Vs1+Vs2 is applied and the high voltage Vs1+Vs2+Vw is applied.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

Figure 1:
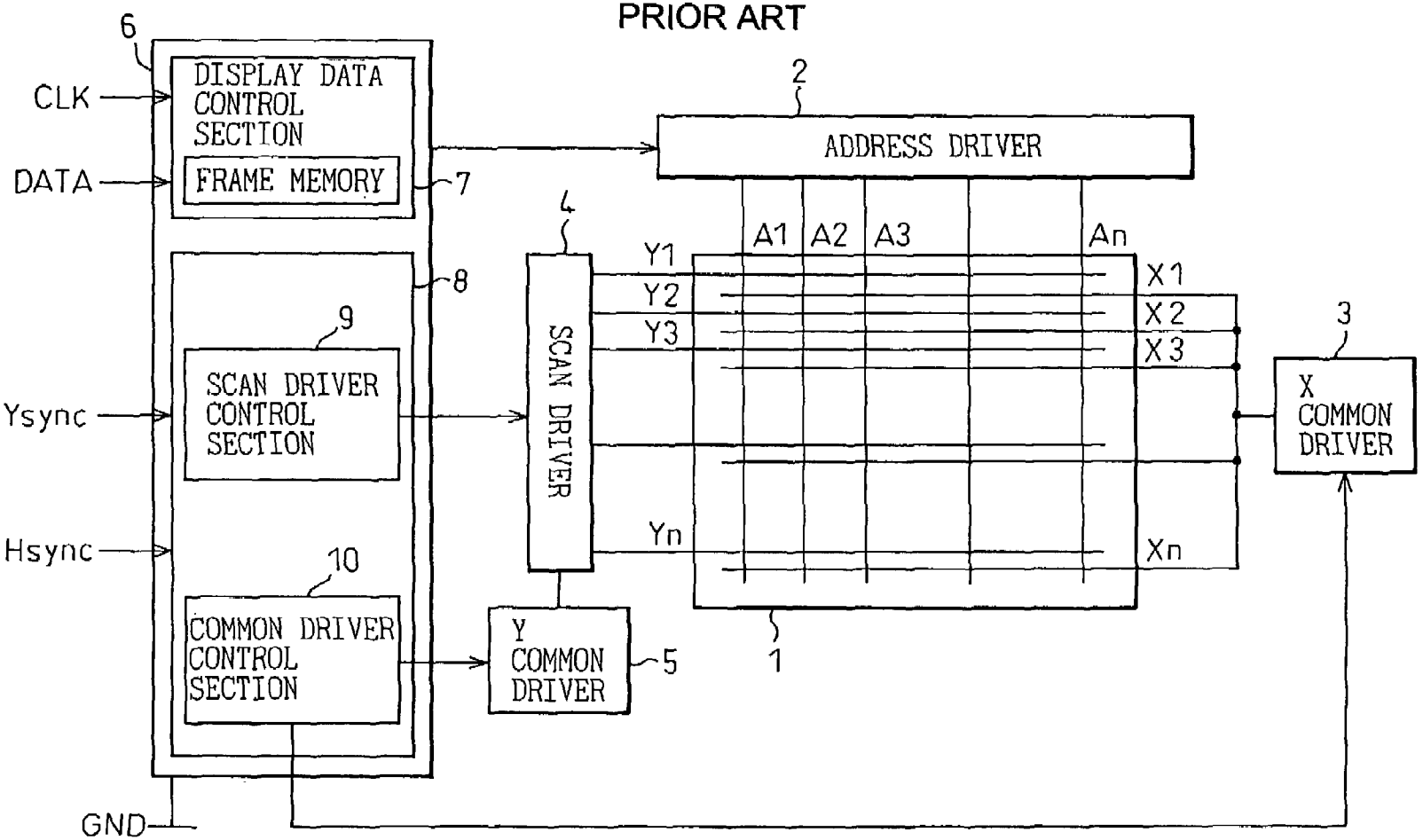
Fig.1 PRIOR ART
FIG. 1 is a diagram that shows the general structure of the plasma display apparatus.
Figure 2:
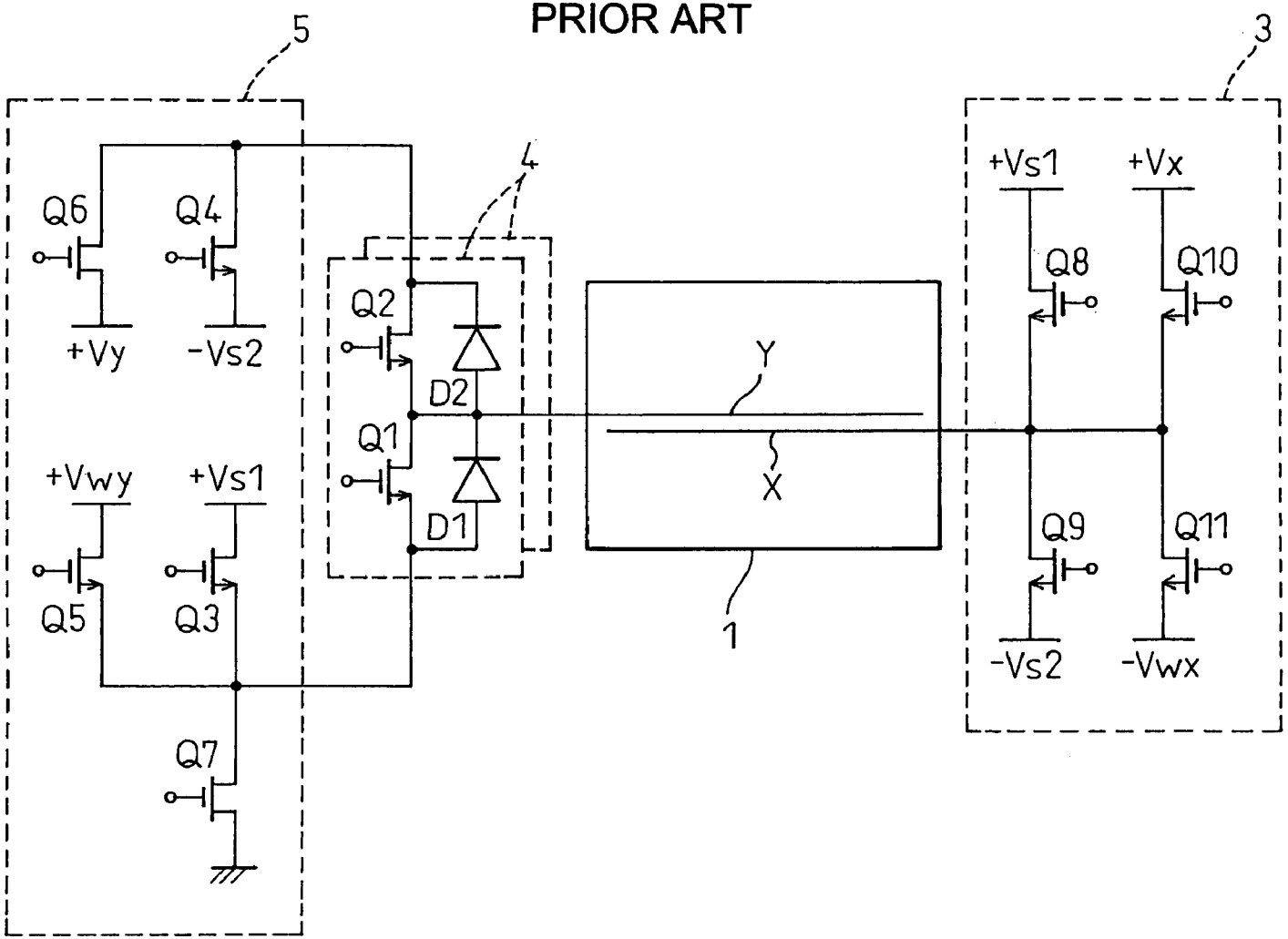
Fig.2 PRIOR ART
FIG. 2 is a diagram that shows an example of the conventional X electrode and Y electrode drive circuit.
Figure 3A:
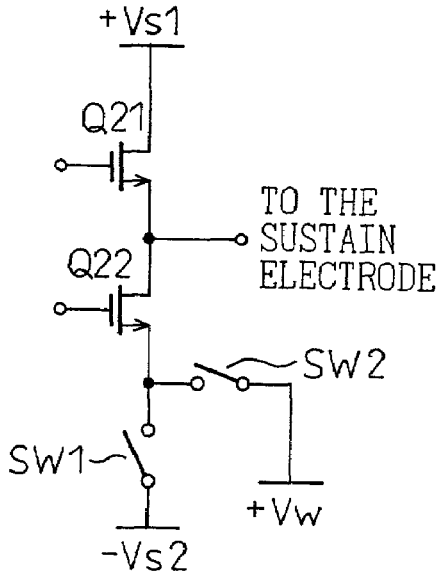
FIG. 3A through FIG. 3C are diagrams that show the fundamental structure of the drive circuit of the present invention.
Figure 3B:
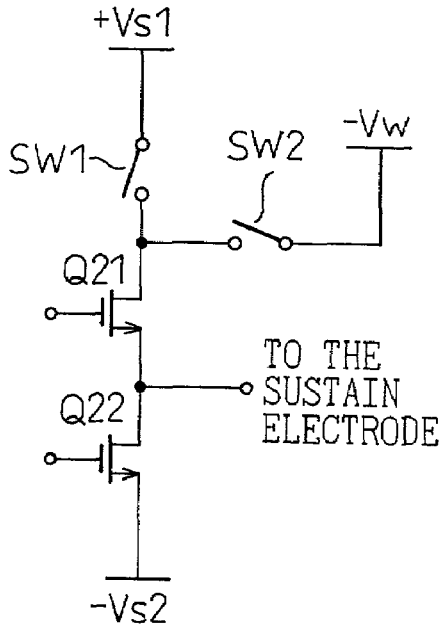
Figure 3C:
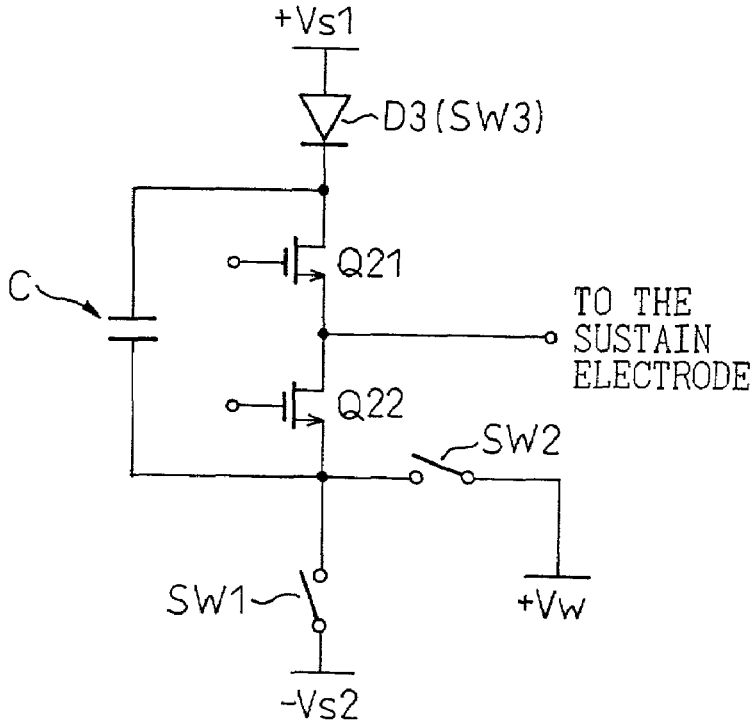
Figure 4:
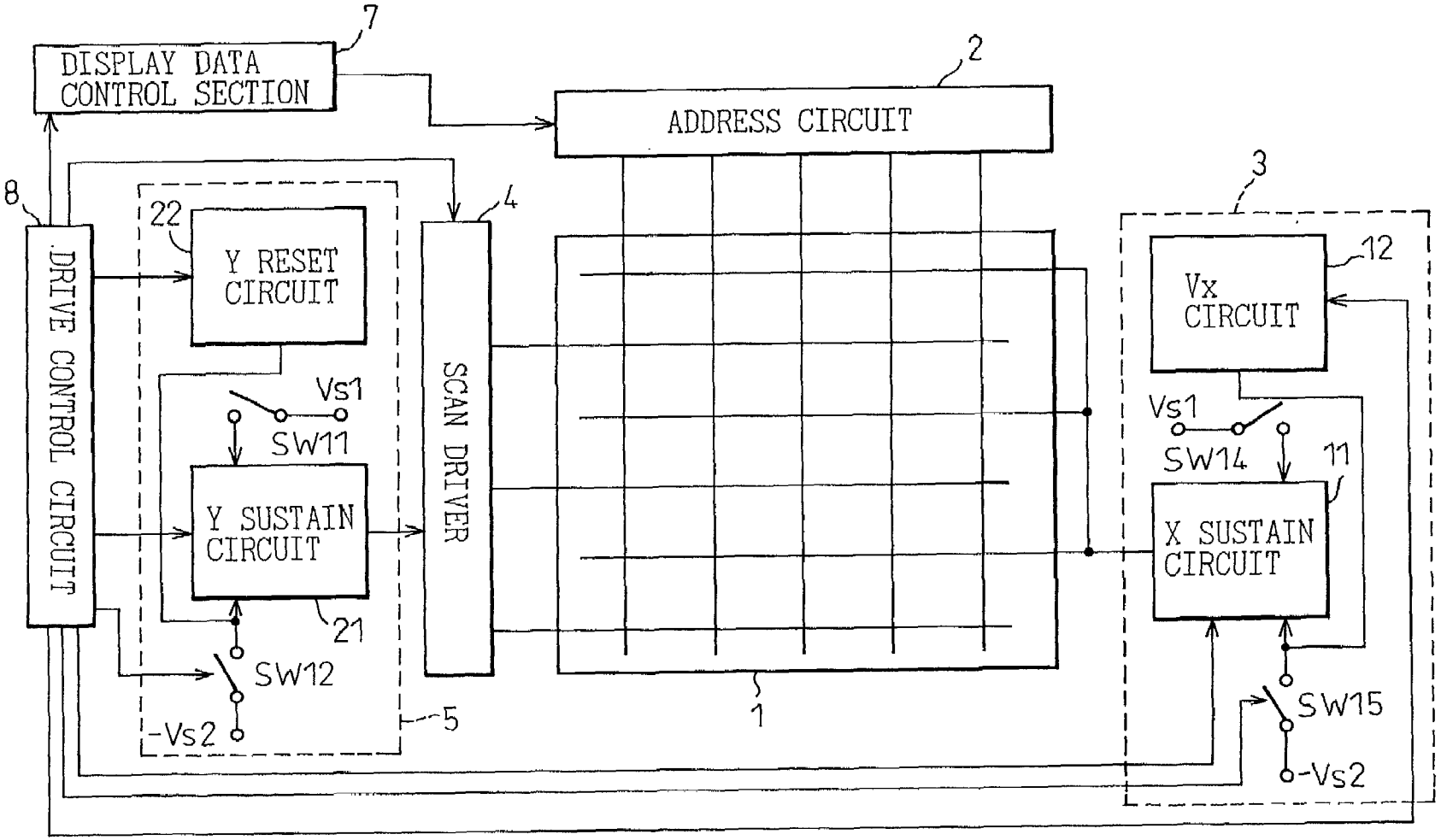
FIG. 4 is a diagram that shows the general structure of the plasma display apparatus in the embodiment of the present invention.

FIG. 4 is a diagram that shows the general structure of the plasma display apparatus in the embodiment of the present invention, and the structures of the X common driver 3 and the Y common driver 5 in FIG. 1 are different from those of a conventional embodiment. As shown schematically, the X common driver 3 comprises an X sustain circuit 11, a Vx circuit 12, a switch SW14 provided in the supply path of the voltage source Vs1 to the X sustain circuit 11, and a switch SW15 provided in the supply path of the voltage source −Vs2 to the X sustain circuit 11. The Y common driver 5 comprises a Y sustain circuit 21, a Y reset circuit 22, a switch 11 provided in the supply path of the voltage source Vs1 to the Y sustain circuit 21, and a switch SW12 provided in the supply path of the voltage source −Vs2 to the Y sustain circuit 21.

Figure 5:
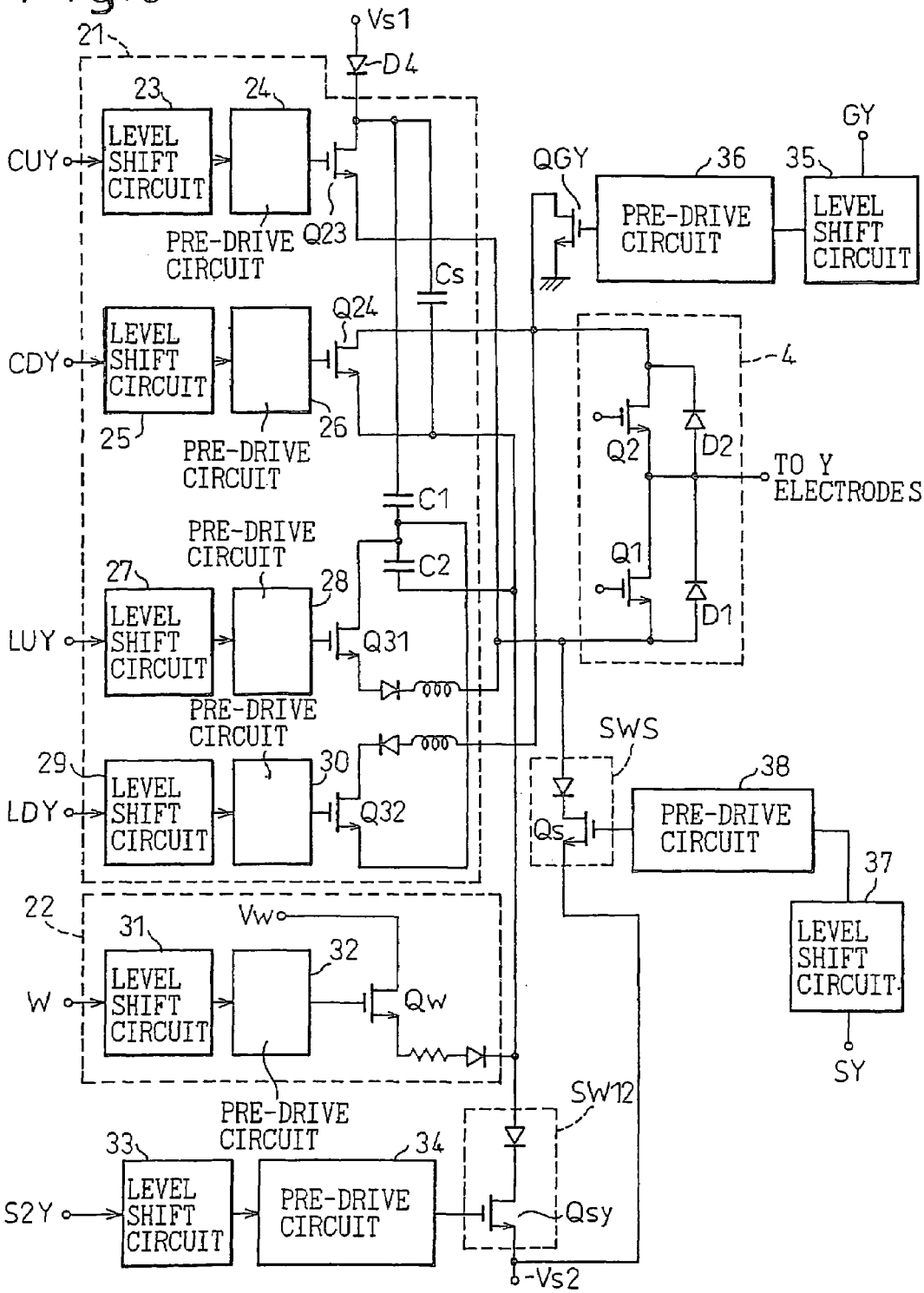
FIG. 5 is a diagram that shows the structure of the Y electrode drive circuit in the first embodiment of the present invention.

FIG. 5 is a diagram that shows the structure of the Y electrode drive circuit including the scan driver 4 and the Y common driver 5 in the first embodiment of the present invention. The scan drive 4 comprises, similarly to the conventional one, the transistors Q1 and Q2 connected in series, the diode D1 provided in parallel to Q1, and the diode D2 provided in parallel to Q2. The transistors Q1 and Q2 are required to be capable of high-speed operations but the withstand voltage need not be so high.

The Y common driver 5 comprises the Y sustain circuit 21, a diode D4 that functions as the switch SW11 provided between the Y sustain circuit 21 and the voltage source +Vs1, the Y reset circuit 22, the switch SW12 provided between the Y sustain circuit 21 and the voltage source −Vs2, a transistor QGY connected between the cathode of D2 and the ground GND, a switch SWS provided between the anode of D1 and the voltage source −Vs2, level shift circuits 33, 35, and 37 that convert the levels of control signals S2Y, GY, and SY, respectively, and pre-drive circuits 34, 36, and 38 that apply the outputs of the level shift circuits 33, 35, and 37 to the gates of a transistor Qsy, the transistor QGY, and a transistor Qs, respectively. The switch SW12 is composed of Qsy and a diode connected in series, and the switch SWS is composed of Qs and a diode connected in series.

The Y sustain circuit 21 comprises a sustain transistor Q23 connected to the anode of D1, a sustain transistor Q24 connected to the cathode of D2, a transistor Q31 connected to the anode of D1 via a diode and an inductance device, a transistor Q32 connected to the cathode of D2 via a diode and an inductance device, level shift circuits 23, 25, 27, and 29 that convert the levels of control signals CUY, CDY, LUY, and LDY of the transistors Q23, Q24, Q31, and Q32, respectively, pre-drive circuits 24, 26, 28, and 30 that apply the outputs of the level shift circuits 23, 25, 27, and 29 to the gates of Q23, Q24, Q31, and Q32, respectively, a capacitor C1 connected between the terminals of Q23 and Q31, a capacitor C2 connected between the terminals of Q24 and Q32, and a capacitor Cs connected between the terminals of Q23 and Q24. The transistors Q31 and Q32, the capacitors C1 and C2, the diode, and the inductance device constitute a power recovery circuit used to recover power that will be used for the next switching when the voltage applied to the Y electrode is switched in the sustain discharge period, and a detailed description of this circuit is omitted because the circuit has been disclosed in Japanese Unexamined Patent Publication (Kokai) No. 7-160219. The sustain transistors Q23 and Q24 are composed of, for example, insulated gate bipolar transistors (IGBT), and those with a withstand voltage of 300 V can be used.

The Y reset circuit 22 comprises a transistor Qw, one terminal of which is connected to the voltage source Vw and the other terminal, to the other terminal of Q24 via a resistor and a diode, a level shift circuit 31 that converts the level of a control signal W, and a pre-drive circuit 32 that applies the output of the level shift circuit 31 to the gate of the transistor Qw.

Figure 6:
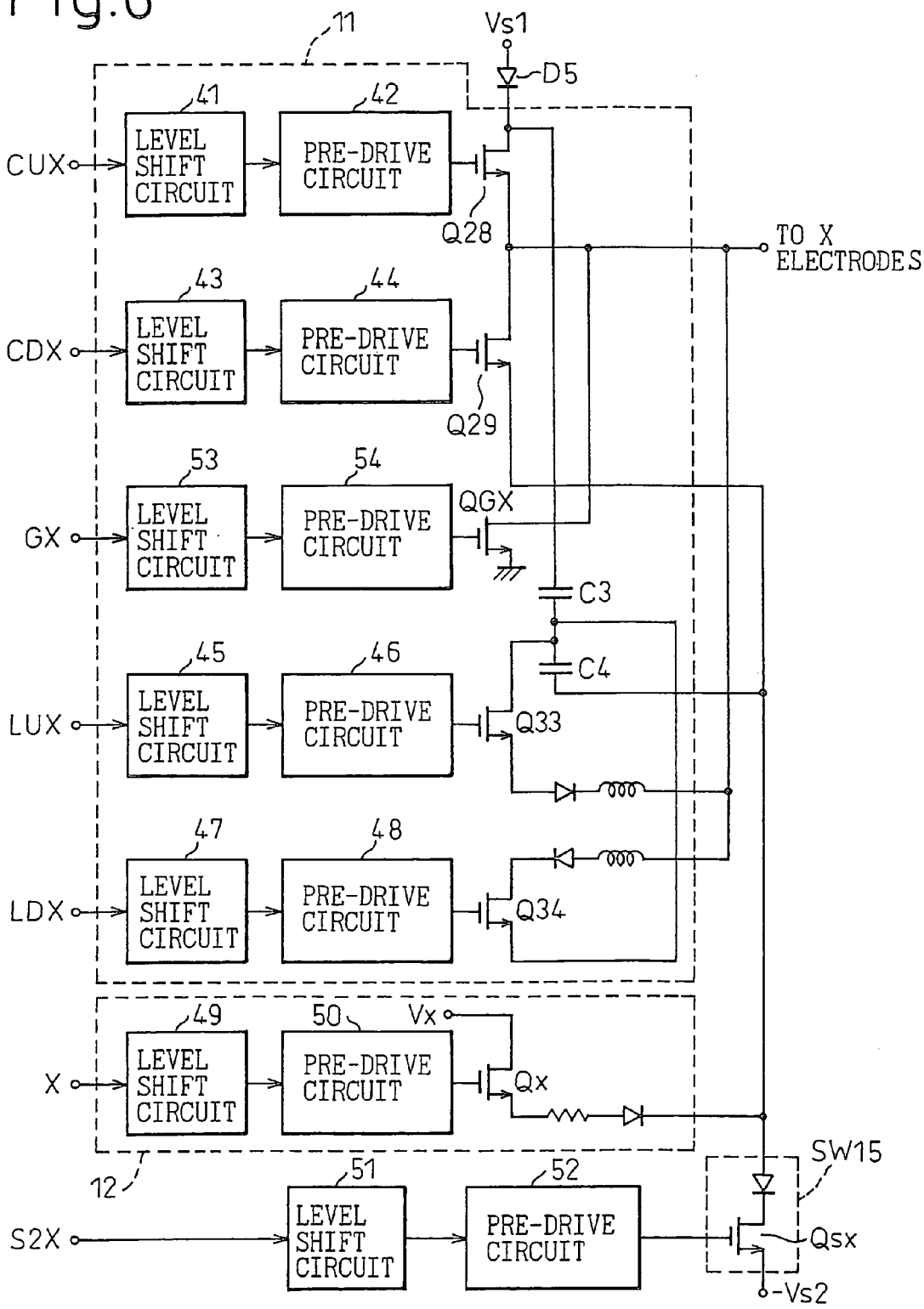
FIG. 6 is a diagram that shows the structure of the X electrode drive circuit in the first embodiment.

FIG. 6 is a diagram that shows the structure of the X common driver 3 in the first embodiment. The X common driver 3 comprises the X sustain circuit 11, a diode D5 that functions as the switch SW14,provided between the X sustain circuit 11 and the voltage source +Vs1, the Vx circuit 12, the switch SW15 provided between the X sustain circuit 11 and the voltage source −Vs2, a level shift circuit 51 that converts the level of a control signal S2X, and a pre-drive circuit 52 that applies the output of the level shift circuit 51 to the gate of a transistor Qsx of the switch 15. The switch SW15 is composed of Qsx and a diode connected in series.

The X sustain circuit 11 comprises sustain transistors Q28 and Q29 connected to the X electrode, a transistor Q33 connected to the X electrode via a diode and an inductance device, a transistor Q34 connected to the X electrode via a diode and an inductance device, a transistor QGX connected between the X electrode and GND, level shift circuits 41, 43, 45, 47, and 53 that convert the levels of control signals CUX, CDX, LUX, LDX, and GX of the transistors Q28, Q29, Q33, Q34, and QGX, respectively, pre-drive circuits 42, 44, 46, 48, and 54 that apply the outputs of the level shift circuits 41, 43, 45, 47, and 53 to the gates of Q28, Q29, Q33, Q34, and QGX, respectively, a capacitor C3 connected between the terminals of Q28 and Q33, and a capacitor C4 connected between the terminals of Q29 and Q34. The transistors Q33 and Q34, the capacitors C3 and C4, the diode and the inductance device constitute a power recovery circuit used to recover power that will be used for the next switching when the voltage applied to the Y electrode is switched in the sustain discharge period.

The Vx circuit 12 comprises a transistor Qx, one terminal of which is connected to the voltage source Vx and the other terminal of which is connected to the other terminal of Q29 via a resistor and a diode, a level shift circuit 49 that converts the level of a control signal X, and a pre-drive circuit 50 that applies the output of the level shift circuit 49 to the gate of the transistor Qx.

Figure 7:
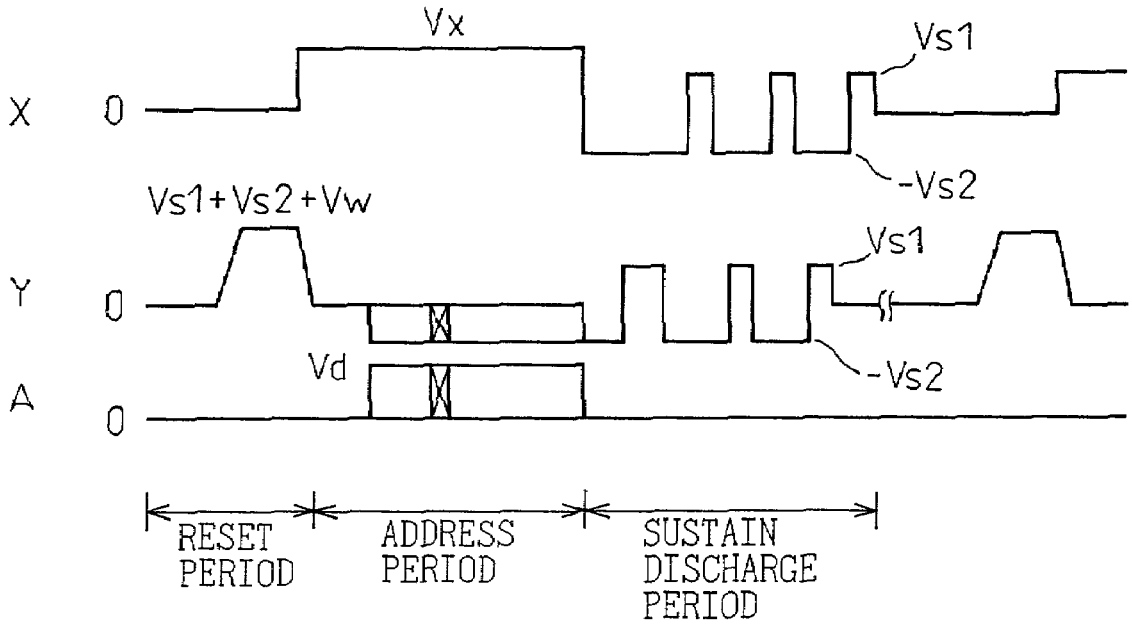
FIG. 7 is a diagram that shows the voltage waveforms applied to each electrode in the first embodiment.

FIG. 7 is a diagram that shows the drive waveforms in the first embodiment. As shown schematically, in the reset period, while the X electrode and the Y electrode are being maintained at 0 V, the high voltage Vs1+Vs2+Vw is applied to the Y electrode to cause an erase discharge to occur. In the address period, while +Vx is being applied to the X electrode, the scan pulse of −Vs2 is applied sequentially to the Y electrode, and when the scan pulse is not applied, GND is applied to the Y electrode and in synchronization with the application of the scan pulse, a data voltage Vd is applied to the address electrode of the cell to be used for display, and GND is applied to the address electrode of the cell not to be used for display. In this way, all the cells enter a state that corresponds to the display data. Instead of the scan pulse of −Vs2, another voltages can be used in this case. It is, however, necessary to provide the transistor Qs shown in FIG. 5 with a voltage source that supplies such a voltage.

In the sustain discharge period, while GND is being applied to the address electrode, +Vs1 and −Vs2 are applied alternately to the X electrode and the Y electrode. In this case, while the base is being maintained at −Vs2 and −Vs2 is being applied to both the X electrode and the Y electrode, after +Vs1 is applied to one of them −Vs2 is applied again, and after +Vs1 is applied to the other one −Vs2 is applied again, and this series of operations is repeated. In this way, the sustain voltage Vs1+Vs2 is applied between the X electrode and the Y electrode, a sustain discharge is caused to occur in the cell to be used for display, and display is attained.

Next, the operations of the circuits in FIG. 5 and FIG. 6 are described with reference to the drive waveforms in FIG. 7. In the reset period, GND is applied to the address electrode and, at the same time, the transistor QGX is turned on and the other transistors are turned off in the X common driver shown in FIG. 6, and the transistor QGY is turned on and the other transistors are turned off in the Y electrode drive circuit shown in FIG. 5. Next QGY is turned off and, at the same time, Qsy is turned on. In this way, the voltage Vs1+Vs2 is maintained across the capacitor Cs. Next Qsy is turned off and at the same time, Qw is turned on, and Q23 is further turned on. In this way voltage VH in the figure becomes Vs1+Vs2+Vw, and the voltage is applied to the Y electrode via Q23 and D1. As a result, an entire surface erase discharge is caused to occur in the panel and all the cells enter a uniform state. Although Vs1+Vs2+Vw is greater than Vs1, the voltages of the both terminals of the sustain transistor Q2 are Vs1+Vs2+Vw and +Vw, respectively, and the difference in voltage is Vs1+Vs2, which is equal to the sustain voltage.

In the address period, QGX is turned off and, at the same time, Q29 and QX are turned on in the circuit shown in FIG. 6 to apply Vx to the X electrode. In this case, +Vs1 and +Vx are eventually applied to both terminals of Q28 and a withstand voltage of Vx−Vs1 or greater is required. It is not necessary to use a transistor of a high withstand voltage here because Vx−Vs1 is less than the sustain voltage Vs1+Vs2, although +Vx is greater than +Vs1. After the circuit shown in FIG. 6 is set to the state as described above, Q23, Qw, and Qsy are turned off and QGY and Qs are turned on in the circuit shown in FIG. 5. In this way, −Vs2 is applied to the terminal of Q1 and GND is applied to the terminal of Q2, therefore, if Q1 is turned on and Q2 is turned off in accordance with the scan pulse, while Q1 is being kept off and Q2 is being kept on, −Vs2 is applied sequentially to the Y electrode and scanning is performed. By applying the data signal of the address electrode in accordance with this, the panel enters the state corresponding to the display data.

In the sustain period, all the transistors except for Qsy are turned off in the circuit shown in FIG. 5 and all the transistors except for Qsx are turned off in the circuit shown in FIG. 6. In this way, a state in which +Vs1 and −Vs2 are being applied to the sustain transistors Q23 and Q24, respectively, is attained. Then, after Q23, Q31, Q28, and Q33 are turned off and Q24, Q32, Q29, and Q34 are turned on, Q31 and Q23 are turned on and Q32 and Q24 are turned off, Q31 and Q23 are turned off and Q32 and Q24 are turned on, Q33 and Q28 are turned on and Q34 and Q29 are turned off, and Q33 and Q28 are turned off and Q34 and Q29 are turned on, and this series of operations is repeated to apply the sustain pulse in common to the X electrodes and selectively, in succession, to the Y electrodes.

As described above, in the first embodiment, even though Vs1+Vs2+Vw or Vx is greater than the sustain voltage Vs1+Vs2, the voltage to be applied to the sustain transistors Q23 and Q24 is less than Vs1+Vs2, therefore, it is not necessary to use a transistor of a high withstand voltage. Although a case in which the high voltage Vs1+Vs2+Vw is applied to the Y electrode is shown in the first embodiment, the present invention can be applied to a case in which a high voltage is applied to the X electrode or a case in which a voltage of the opposite polarity is applied to cause an erase discharge to occur, and the voltage that develops across the sustain transistor can be reduced to the sustain voltage or less. Moreover, although the capacitor Cs is used to generate the high voltage Vs1+Vs2+Vw in the first embodiment, it is possible that a voltage source that outputs such a voltage is provided, and Qsy is turned off and the voltage source −Vs2 is separated, similarly to the case of the X common drive shown in FIG. 6, and this high voltage is applied to the terminal of the sustain transistor Q24.

Figure 8:
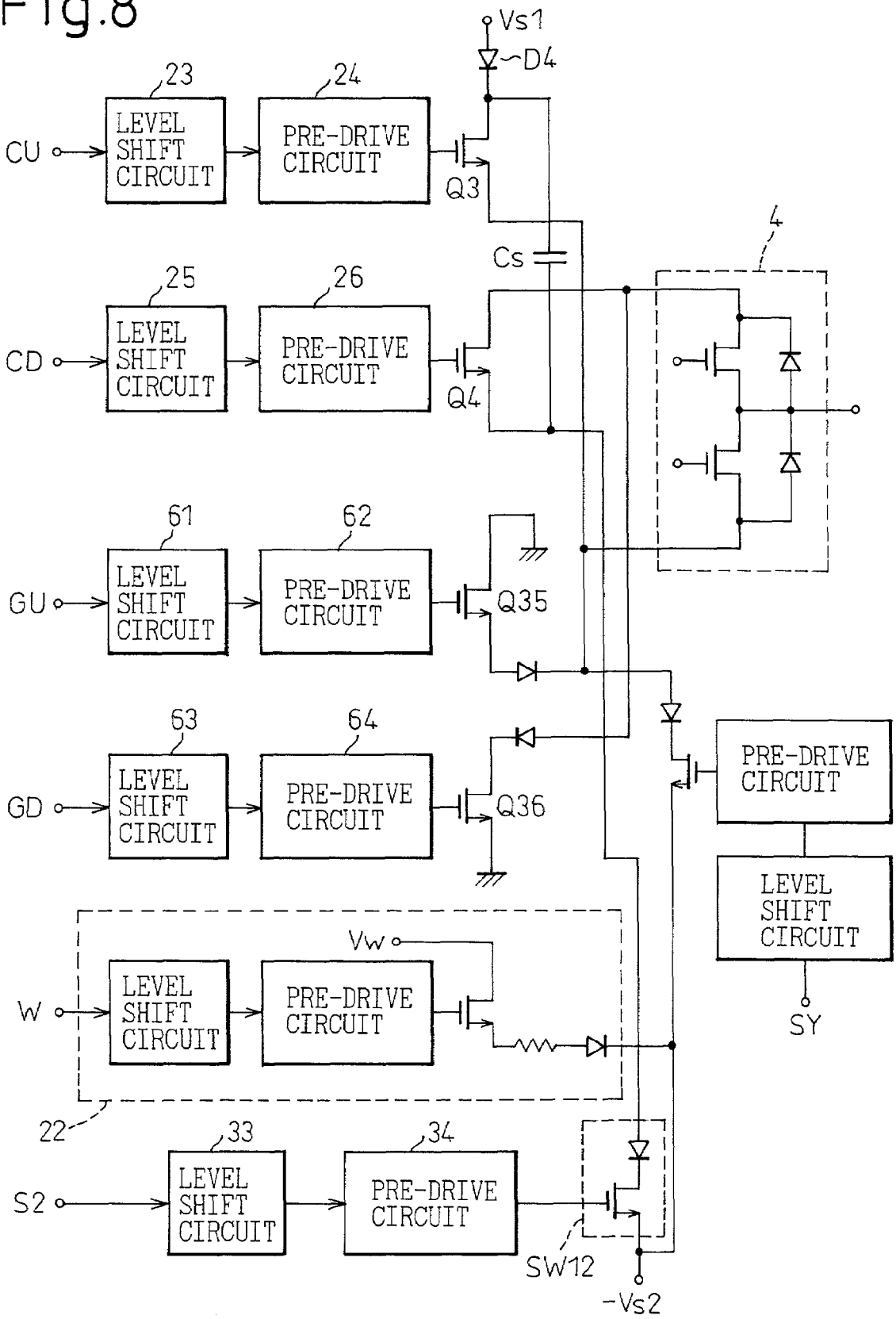
FIG. 8 is a diagram that shows the structure of the Y electrode drive circuit in the second embodiment of the present invention.

FIG. 8 is a diagram that shows the structure of the Y electrode drive circuit in the second embodiment of the present invention. As is obvious from a comparison with FIG. 5, a difference exists in that, such as the transistors Q31 and Q32 and the capacitors C1 and C2 that constitute the power recovery circuit in the first embodiment are removed, instead, a transistor Q35, one terminal of which is connected to the anode of D1 via a diode and the other terminal is connected to GND, and a transistor Q36, one terminal of which is connected to the cathode of D2 via a diode and the other terminal is connected to GND, are provided. Moreover, level shift circuits 61 and 63 and pre-drive circuits 62 and 64 for control signals GU and GD of Q35 and Q36 are also provided. As for the X common driver, such as the transistors Q33 and Q34 and capacitors C3 and C4 that constitute the power recovery circuit are removed similarly, instead, a transistor connected between the X electrode and GND is provided, but the diagrams and the description are omitted here.

Figure 9:
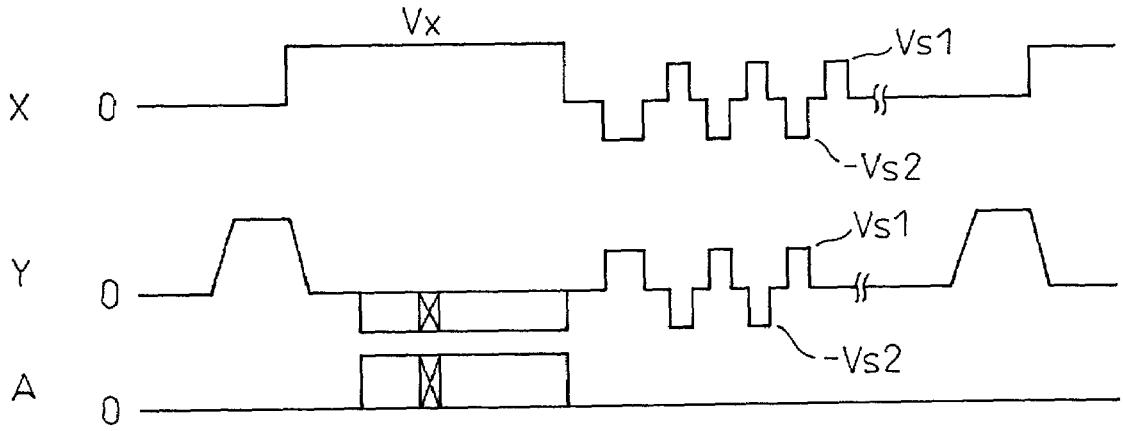
FIG. 9 is a diagram that shows the voltage waveforms applied to each electrode in the second embodiment.

FIG. 9 is a diagram that shows the drive waveforms of the plasma display apparatus in the second embodiment. The difference from the drive waveforms in the first embodiment exists in that the voltage, which is applied to the X electrode and the Y electrode, is once made GND when it is switched between +Vs1 and −Vs2 in the sustain discharge period. The operations in the circuit shown in FIG. 8 in this case are, for example, that from the state in which Q23 is turned on and +Vs1 is applied to the Y electrode, Q36 is turned on and GND is once applied after Q23 is turned off, then Q36 is turned off, Q24 is turned on, and −Vs2 is applied.

In the second embodiment, the sustain discharge pulse waveforms are stepped as shown in FIG. 9. As a result, the quantity of change in voltage at the rise and fall of the sustain discharge pulse can be reduced, resulting in reduction in power consumption.

Figure 10:
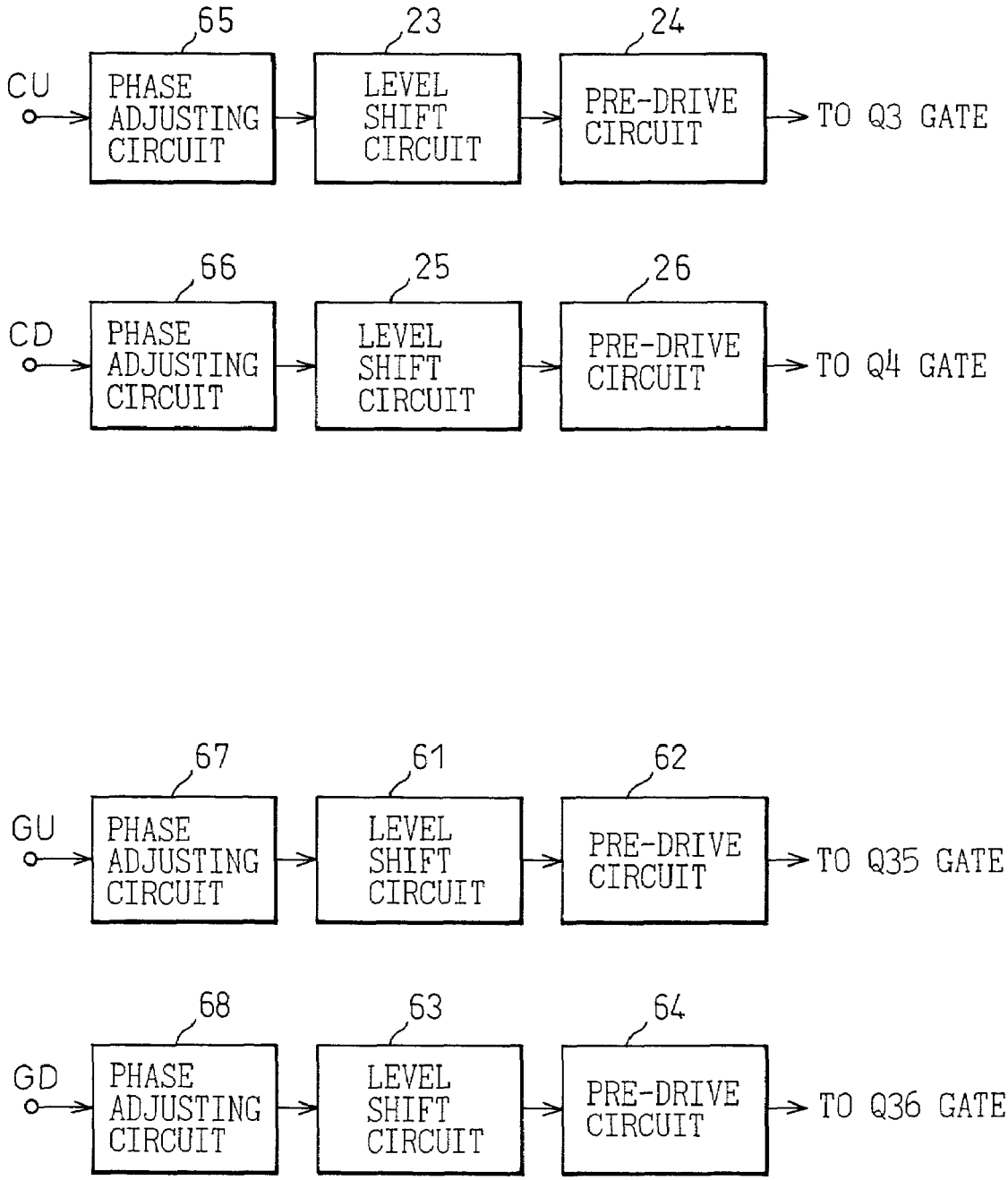
FIG. 10 is a diagram that shows an example of a modified structure of the second embodiment.
Figure 11:
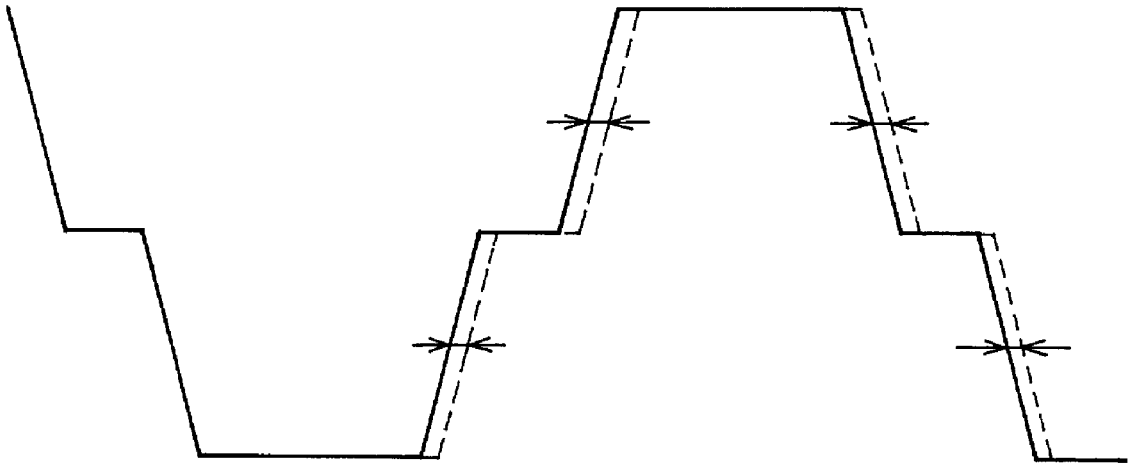
FIG. 11 is a diagram that illustrates the operations of the modified example.

It is, however, necessary to accurately adjust the sustain discharge pulse when it is stepped as shown in FIG. 9. As shown in FIG. 10, it is also possible to provide phase adjusting circuits 65, 66, 67, and 68 that adjust the phases of the control signals CU, CD, GU, and GD, respectively, in the circuit in the second embodiment shown in FIG. 8 to adjust the phase of the transiting edge of the sustain discharge pulse and form the sustain discharge pulse as shown in FIG. 11, and to attain a reduction in power consumption. If this phase adjustment is employed in the power recovery circuit in the first embodiment, it will be possible to improve the efficiency of power recovery.

Figure 12:
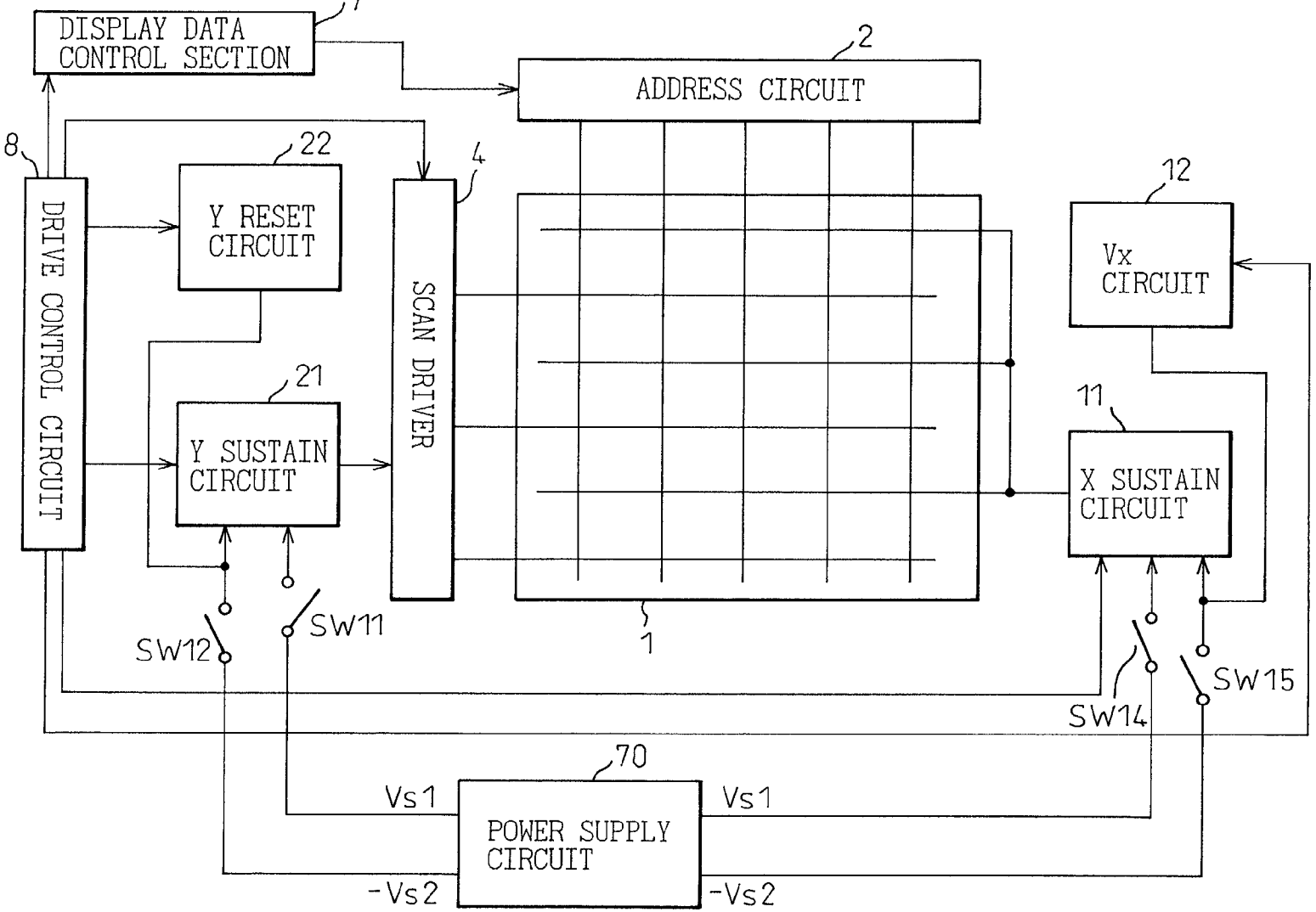
FIG. 12 is a diagram that shows the general structure of the plasma display apparatus in the third embodiment of the present invention.

FIG. 12 shows the general structure of the plasma display apparatus in the third embodiment of the present invention, including a power supply circuit 70 that is not shown in FIG. 4. The power supply circuit 70 supplies the power supply voltages +Vs1 and −Vs2 to the X sustain circuit 11 and the Y sustain circuit 21 via the switches 14, 15, 11, and 12.

Figure 13A:
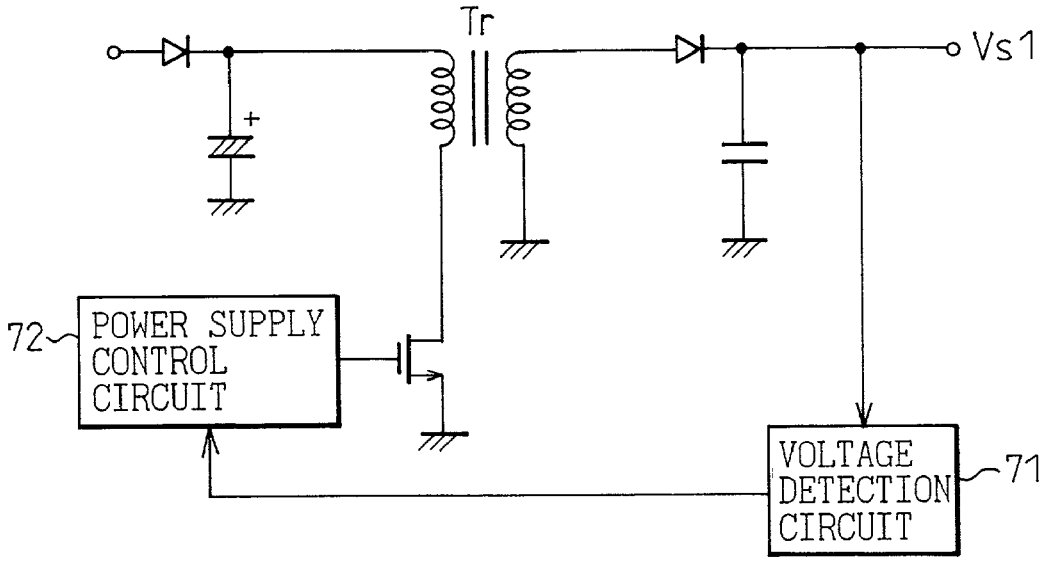
FIG. 13A and FIG. 13B are diagrams that show an example of the structure of the power supply circuit in the third embodiment.
Figure 13B:
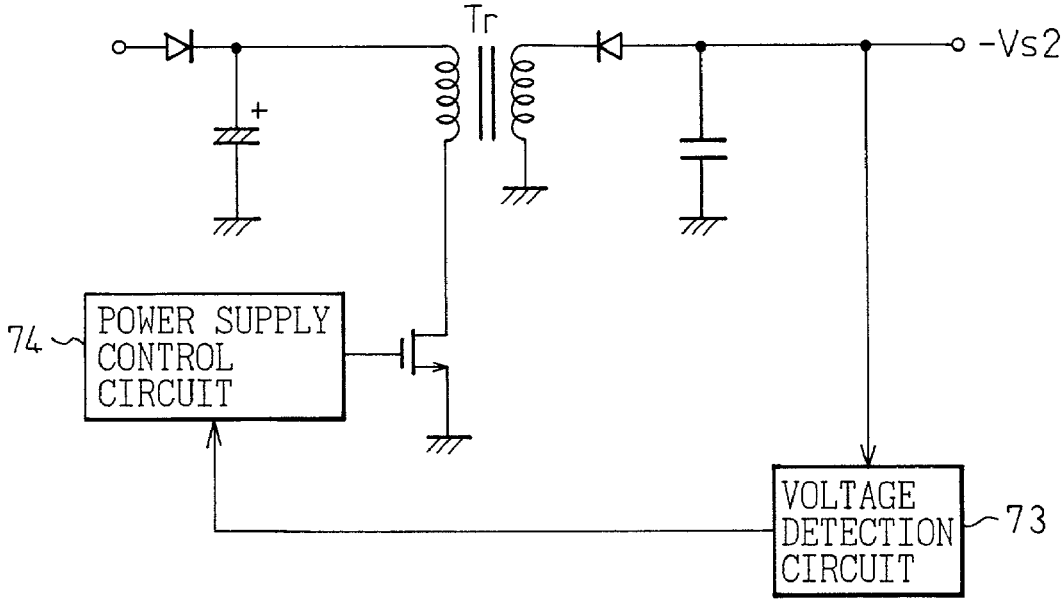

FIG. 13A and FIG. 13B are diagrams that show examples of the structure of the power supply circuit 70. FIG. 13A shows the structure of the part that generates the power supply voltage +Vs1 and FIG. 13B shows that of the part that generates the power supply voltage −Vs2. As shown schematically, the flow of the current in the primary can be controlled by the on/off control of the transistor with power supply control circuits 72 and 74. The intermittent flow of the current in the primary generates an alternating voltage on the secondary according to the ratio of winding turns of a transformer Tr. By rectifying this voltage with a diode, and smoothing it with a capacitor, +Vs1 and −Vs2 are generated. The amount of charge supplied from the output terminals of the power supply voltages +Vs1 and −Vs2 to the panel 1 differs depending on the displayed image. Here, +Vs1 and −Vs2 output from voltage detection circuits 71 and 73 are detected and the detected values are fed back to the power supply control circuits 72 and 74. The power supply control circuits 72 and 74 are designed in such a way as to change the duty ratio with which the transistor is turned on according to the detected voltage value and to output the stable power supply voltages +Vs1 and −Vs2 constantly.

Figure 14A:
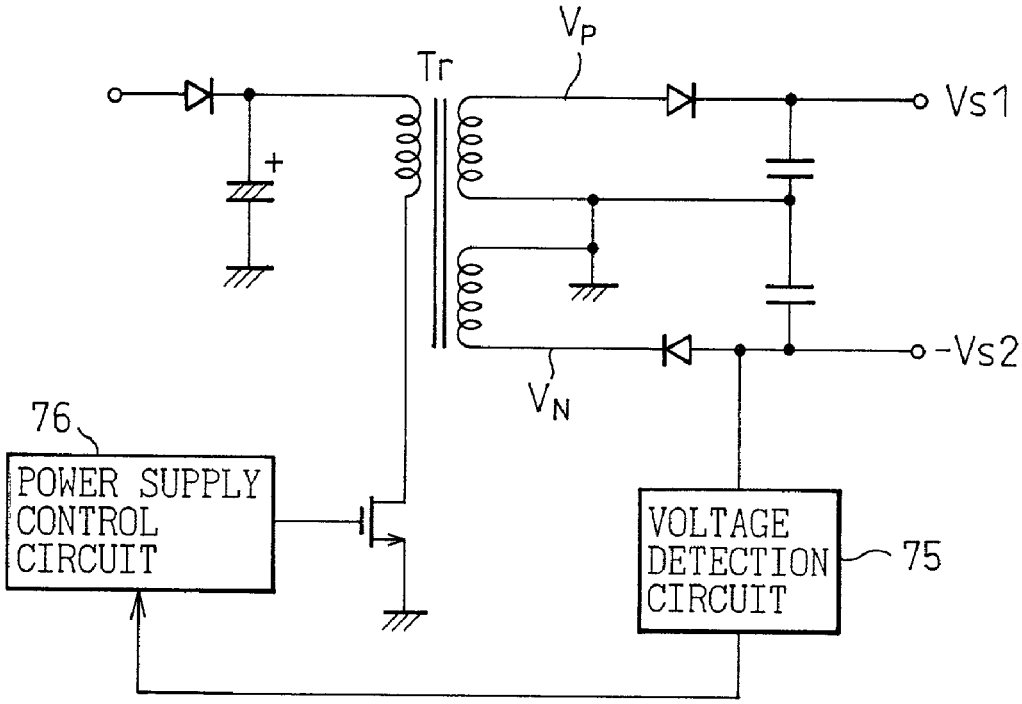
FIG. 14A and FIG. 14B are diagrams that show another example of the structure of the power supply circuit in the third embodiment.
Figure 14B:
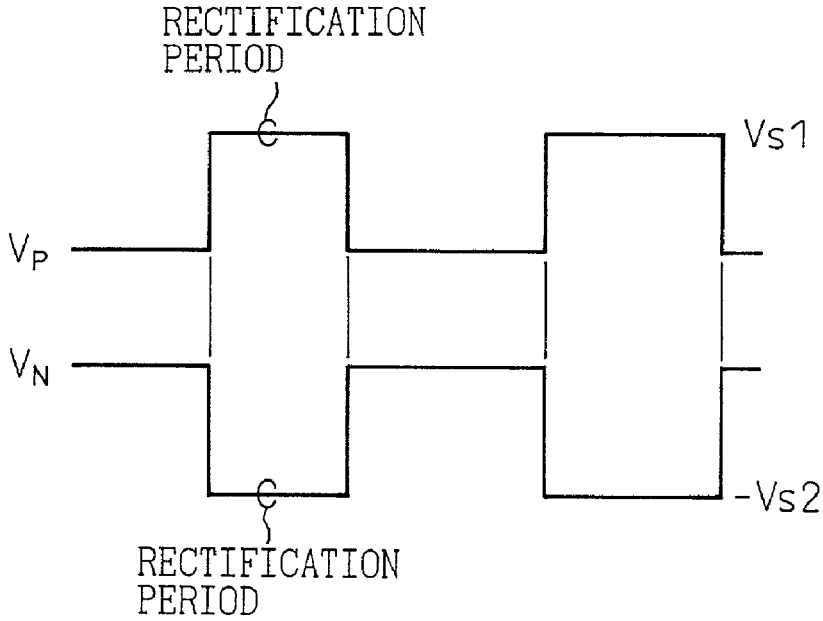

FIG. 14A and FIG. 14B are diagrams that show examples of another structure of the power supply circuit 70. FIG. 14A illustrates the structure and FIG. 14B illustrates the operations. As shown in FIG. 14A, one end of each of two coils on the secondary is connected to another.

In the circuit shown in FIG. 14A, the voltage −Vs2 is detected in a voltage detection circuit 75 and the drive signal that is supplied from a power supply control circuit 76 to the transistor is controlled to adjust the voltage −Vs2 to be constant. The period, during which the load current flows from the output terminal of the voltage −Vs2, corresponds to the rectification period shown by voltage VN in FIG. 14B. When the rectification period of the VN waveform coincides with that of voltage VP, the load current flows also from the output terminal of the voltage Vs1. By designing the transformer Tr shown in FIG. 14A in such a way as to attain such polarities, it is possible to match the periods during which the load current flows from the output terminal of the voltage Vs1 and from that of the voltage −Vs2. As a result, even when only the voltage −Vs2 is detected as described above, it is possible to set the voltage Vs1 to an adequate voltage. The present invention provides an effect that such as the voltage detection circuit and the voltage control circuit shown in FIG. 13 can be integrated into a single circuit by employing the circuit shown in FIG. 14. It is also applicable to the case in which only the voltage Vs1 is detected and controlled instead of the voltage −Vs2.

According to the plasma display apparatus of the present invention, even when a voltage greater than the sustain voltage is applied to the sustain electrode, a device of a relatively low withstand voltage can be used because the voltage applied across the sustain output device (transistor) is less than the sustain voltage, resulting in reduction in chip size and cost.

We claim:

1. A plasma display apparatus comprising a display panel having first electrodes and second electrodes arranged adjacent, by turns, in a direction intersecting third electrodes, an X drive circuit that drives the first electrodes, and a Y drive circuit that drives the second electrodes, wherein:

a first voltage and a second voltage, which is lower than the first voltage, are applied alternately to the first electrodes and the second electrodes to cause a sustain discharge to occur between the first electrodes and the second electrodes;

the X drive circuit or the Y drive circuit comprising:

a first sustain drive transistor, a first terminal of which is connected to one of the first electrodes and the second electrodes, and a second terminal of which is connected to a supply source of the first voltage, the first sustain drive transistor supplying the first voltage to the one of the first electrodes and the second electrodes in response to a control signal supplied to a third terminal thereof, and a second sustain drive transistor, a first terminal of which is connected to the one of the first electrodes and the second electrodes, and the first terminal of the first sustain drive transistor, a second terminal of which is connected to a supply source of the second voltage, and the second sustain drive transistor supplying the second voltage to the one of the first electrodes and the second electrodes in response to a control signal supplied to a third terminal thereof;

a third voltage, which is higher than the first voltage, is applied to the one of the first electrodes and the second electrodes;

the X drive circuit or the Y drive circuit, to which the third voltage is applied, comprises a first switch provided between the second sustain drive transistor and the supply source of the second voltage; and the third voltage is supplied to the second sustain drive transistor when the first switch is in an open state, wherein:

the X drive circuit or the Y drive circuit, to which the third voltage is applied, comprises a second switch provided between the supply source of a fourth voltage and the second sustain drive transistor, a third switch provided between the first sustain drive transistor and the supply source of the first voltage, and a capacitor provided between the other terminal of the first sustain drive transistor and the other terminal of the second sustain drive transistor, and the third voltage is generated by a procedure, in which the first and the third switches are closed, the first and the third switches are then opened and the second switch is closed from the state in which the second switch is opened and the voltage difference between the first and the second voltages is maintained across the capacitor, and the fourth voltage is applied to one of the terminals of the capacitor and the fourth voltage is added to the voltage difference between the first and the second voltages at the other terminal of the capacitor, and is supplied to the first sustain drive transistor.

2. A plasma display apparatus as set forth in claim 1, wherein the first and the second sustain drive transistors are insulated gate bipolar transistors.

3. A plasma display apparatus as set forth in claim 1, comprising a power supply circuit that supplies the first voltage and the second voltage, wherein the power supply circuit has a voltage detection circuit that detects at least one of the first voltage and the second voltage, and a voltage control circuit that stabilizes the first voltage and the second voltage based on the detected voltage.

4. A plasma display apparatus comprising a display panel having first electrodes and second electrodes arranged adjacent by turns in a direction intersecting third electrodes, an X drive circuit that drives the first electrodes, and a Y drive circuit that drives the second electrodes, wherein:

a first voltage and a second voltage, which is lower than the first voltage, are applied alternately to the first electrodes and the second electrodes to cause a sustain discharge to occur between the first electrodes and the second electrodes;

the X drive circuit or the Y drive circuit comprising:

a first sustain drive transistor, a first terminal of which is connected to one of the first electrodes and the second electrodes, and a second terminal of which is connected to a supply source of the first voltage, the first sustain drive transistor supplying the first voltage to the one of the first electrodes and the second electrodes in response to a control signal supplied to a third terminal thereof, and a second sustain drive transistor, a first terminal of which is connected to the one of the first electrodes and the second electrodes, and the first terminal of the first sustain drive transistor, a second terminal of which is connected to a supply source of the second voltage, and the second sustain drive transistor supplying the second voltage to the one of the first electrodes and the second electrodes in response to a control signal supplied to a third terminal thereof;

a third voltage, which is lower than the second voltage, is applied to the one of the first electrodes and the second electrodes;

the X drive circuit or the Y drive circuit, to which the third voltage is applied, comprises a first switch provided between the first sustain drive transistor and the supply source of the first voltage; and the third voltage is supplied to the first sustain drive transistor when the first switch is in an open state, wherein:

the X drive circuit or the Y drive circuit, to which the third voltage is applied, comprises a second switch provided between the supply source of a fourth voltage and the first sustain drive transistor, a third switch provided between the second sustain drive transistor and the supply source of the second voltage, and a capacitor provided between the other terminal of the first sustain drive transistor and the other terminal of the second sustain drive transistor, and the third voltage is generated by a procedure in which the first and the third switches are closed, the first and the third switches are then opened and the second switch is closed from the state in which the second switch is opened and the voltage difference between the first and the second voltages is maintained across the capacitor, and the fourth voltage is applied to one of the terminals of the capacitor and the fourth voltage is added to the voltage difference between the first and the second voltages at the other terminal of the capacitor, and is supplied to the first sustain drive transistor.

5. A plasma display apparatus as set forth in claim 4, wherein the first and the second sustain drive transistors are insulated gate bipolar transistors.

6. A plasma display apparatus as set forth in claim 4, comprising a power supply circuit that supplies the first voltage and the second voltage, wherein the power supply circuit has a voltage detection circuit that detects at least one of the first voltage and the second voltage, and a voltage control circuit that stabilizes the first voltage and the second voltage based on the detected voltage.

* * * * *